United States Patent [19]

Brenner, Jr.

[11] 3,931,541

[45] Jan. 6, 1976

[54] CONNECTIVE MEANS FOR A CATHODE RAY TUBE MASK-PANEL ASSEMBLY

[75] Inventor: Kurt H. Brenner, Jr., Seneca Falls, N.Y.

[73] Assignee: GTE Sylvania Incorporated, Stamford, Conn.

[22] Filed: May 5, 1975

[21] Appl. No.: 574,237

Related U.S. Application Data

[63] Continuation of Ser. No. 464,495, April 26, 1974, abandoned.

[52] U.S. Cl. ..... 313/407; 313/451

[51] Int. Cl.[2] ..... H01J 29/06; H01J 29/02

[58] Field of Search ..... 313/402, 403, 404, 405, 313/406, 407, 408

[56] References Cited

UNITED STATES PATENTS

| | | | |
|---|---|---|---|
| 3,404,303 | 10/1968 | Levin | 313/406 |
| 3,502,942 | 3/1970 | Khan et al. | 315/31 |
| 3,541,373 | 11/1970 | Barr | 313/407 |
| 3,543,072 | 11/1970 | McNeil | 313/407 |
| 3,588,567 | 6/1971 | MacLean et al. | 313/402 |
| 3,621,318 | 11/1971 | Lewinson | 313/405 |

*Primary Examiner*—Robert Segal
*Attorney, Agent, or Firm*—Norman J. O'Malley; Frederick H. Rinn; Cyril A. Krenzer

[57] ABSTRACT

An improvement is provided in a color cathode ray tube mask-panel assembly to assure positive electrical contact between the apertured mask member and the sidewall portion of the viewing panel. Resilient electrical contactor means positioned in the spacing between the mask member and the panel, is maintained in a flexed attitude with the attachment portion thereof affixed to the frame and an integral flexural contact portion so oriented to effect constant pressured contact with the conductively coated sidewall of the panel.

1 Claim, 4 Drawing Figures

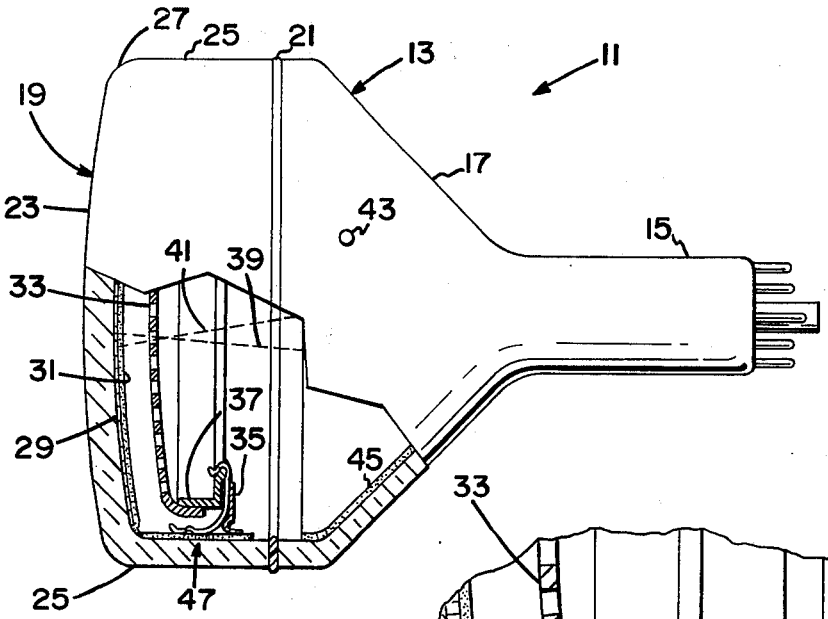
Fig. 1
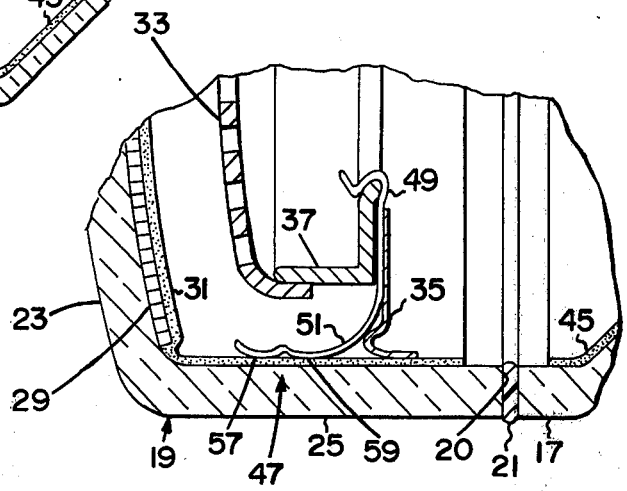
Fig. 1A
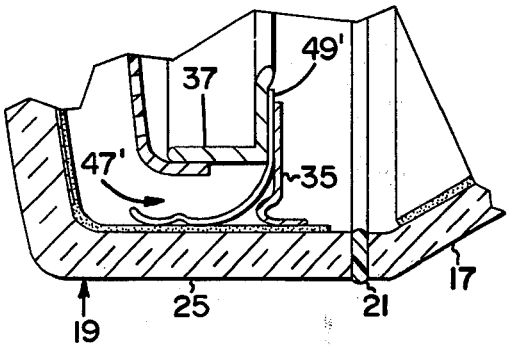
Fig. 3
Fig. 2
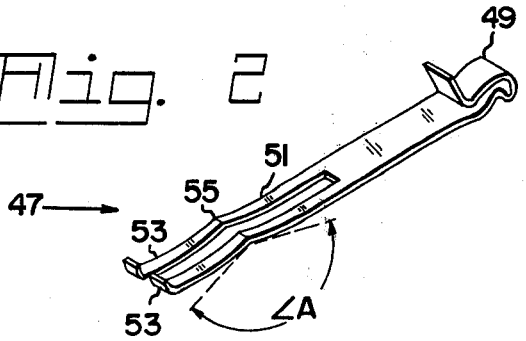

CONNECTIVE MEANS FOR A CATHODE RAY TUBE MASK-PANEL ASSEMBLY

CROSS REFERENCE TO RELATED APPLICATION

This application is a continuation of Ser. No. 464,495, filed Apr. 26, 1974, now abandoned.

BACKGROUND OF THE INVENTION

This invention relates to electrical connective means within a cathode ray tube and more particularly to electrical contactor means for improving the electrical connection between the mask-member and the associated conductively coated panel of a color cathode ray tube.

Color cathode ray tubes as conventionally employed in television applications, usually have encompassing envelopes comprising integrations of neck, funnel, and face panel portions whereof the face panel includes an extensive viewing area upon which a patterned cathodoluminescent screen is disposed. The face panel is conventionally formed to have a substantially upstanding perimetrical sidewall therearound, the edge of which is hermetically joined to the seating edge of a compatibly shaped funnel portion by a sealing procedure during tube manufacturing. The interior of the panel, including the screen and the surrounding panel sidewall is usually metallized with a film of aluminum after formation of the patterned screen. This metallic film serves two functions: first, it provides a segment of the electrical conductive path for the screen potential, and secondly, the presence of the reflective film upon the back of the screen enhances the brightness of the color-emitting phosphors comprising the patterned imagery emanating therefrom. Spatially positioned within the face panel, is a multiple-opening mask member formed of a substantially domed apertured member, the edge of which is peripherally supported by an attached circumscribing framing member. This composite mask structure is supported within the face panel, in spaced relationship to the viewing area, by a plurality of suitable positional means attached about the frame member in a manner to mate with supporting studs embedded in and projecting from the wall of the panel.

Upon completion of the screen forming process, the mask-panel assembly is hermetically sealed to the funnel portion of the envelope. Electron generating means in the form of a structure embodying one or more electron guns, is then positioned and sealed within the neck portion of the envelope, whereupon the tube is subsequently evacuated and processed.

Under conventional operating conditions, the screen potential in a shadow-mask color cathode ray tube is substantially that of the final anode electrode of the electron gun structure, such being achieved by a diverse internal conductive path within the tube envelope. The final anode electrode of the gun structure usually makes electrical contact by supportive snubber means with an electrically conductive coating, such as Aquadag, which is applied to the interior surface of the funnel portion of the tube envelope. A relatively high voltage electrical potential is conventionally applied to this conductive coating by means of a button-type connection oriented in the wall of the aforesaid funnel portion. The other differential voltages required for the successful operation of the electron gun structure, are supplied to the respective electrodes therein by specific electrical conductive means terminating at the connective pins traversing the base portion. These pins, in turn, are connected to suitable voltage sources external of the tube. The final anode voltage, which is supplied to the conductive coating on the internal surface of the funnel, is connected to the apertured mask by a resilient contact member attached to the frame of the mask and extended therefrom to make pressured contact with the coating. Electrical connection between the mask and the screen of the tube is consummated through the spaced-apart mask positioners in conjunction with the mating supporting studs protruding from the panel sidewall and the aluminized film disposed thereon. The studs are usually kept free of aluminum to avoid the prevalence of metallic flakes resultant of subsequent mask positioning in the panel. Since the mask positioning means per se makes riding contact with the supporting studs, electrical connection between the mask and the aluminized panel is provided by applying an area of an additional conductive coating, such as Aquadag, to at least a portion of the stud proper to assure electrical contact between the stud and the adjacently disposed aluminum film on the panel sidewall. However, deleterious effects have been noted in the form of erosion between the Aquadag and the aluminum film, accidental splashing of Aquadag on the mask or screen, and the undesirable prevalence of loose particles and flakes of Aquadag in the vicinity of the mask and screen.

OBJECTS AND SUMMARY OF THE INVENTION

It is an object of the invention to reduce and obviate the aforementioned disadvantages evidenced in the prior art. Another object of the invention is to provide an improved electrical connection between the mask and the aluminized sidewall of the face panel. A further object of the invention is to provide improved electrical connection means between the mask and panel portions of a color cathode ray tube that is free of extraneous coating materials.

These and other objects and advantages are achieved in one aspect of the invention wherein electrical contact means formed as a substantially longitudinal member of resilient metallic material is comprised of an attachment portion and an integral flexural contact portion. When incorporated into the mask-panel assembly, the flexural portion is located in the spacing existent between the mask frame and the panel sidewall in a substantially flexed position. In this attitude, the attachment portion is oriented against the frame of the mask wherein it is suitably affixed. The flexed positioning of the integral flexural portion effects constant pressured contact with the sidewall of the panel to provide a positive electrical connection between the mask and the conductive film covering at least a portion of the sidewall area of the panel.

BRIEF DESCRIPTION OF THE DRAWINGS

FIG. 1 is a partially sectioned view of a color cathode ray tube wherein the invention is utilized;

FIG. 1A is an enlarged section of FIG. 1 detailing the region of the invention;

FIG. 2 is a perspective of one embodiment of the electrical contactor means of the invention prior to incorporation in the mask-panel assembly; and FIG. 3 is a sectional enlarged fragmentation of the mask-panel structure detailing another embodiment of the invention.

DESCRIPTION OF THE PREFERRED EMBODIMENT

For a better understanding of the present invention, together with other and further objects, advantages and capabilities thereof, reference is made to the following specification and appended claims in connection with the aforedescribed drawings.

With particular reference to FIG. 1, there is shown a cathode ray tube 11 having an envelope 13 comprised of neck, funnel, and face panel portions, 15, 17, and 19 respectively, whereof the panel portion 19 is hermetically joined to the funnel portion 17 along the seal line 21. The face panel 19 has a viewing portion 23 and a substantially perimetrical sidewall portion 25 which extends angularly from a transitional zone thereon, the sidewall portion being terminated by the sealing edge 20. Formed on the interior surface of the viewing panel 23 is a patterned cathodoluminescent screen 29 formed of a plurality of discrete areas of color-emitting phosphor materials. Usually a thin metallized film 31, such as aluminum, is disposed over the interior surface of the screen and at least a portion of the adjacent sidewall area of the panel. A discretely apertured structure or mask member 33 is spatially related to the patterned screen 29, being predeterminately positioned within the face panel 19 by usual means such as supporting stud-like members embedded in the sidewall of the panel and projecting therefrom to mate with locators integral with the mask member. For purposes of clarity, the conventional stud-like supporting members and mask locators have been eliminated from the drawings. Attached to the mask member 33 is a peripheral strip-like beam shielding means 35 which is located to extend from the frame of the mask 37 in a bridging manner to make contact with the panel sidewall thereby protecting the cathodoluminescent screen from deleterious electron excitation resultant from the peripheral overscan of electron beams, such as for example 37 and 39, emanating from a beam generating source, not shown, positioned in the neck portion 15 of the tube envelope.

From an operational consideration, the final anode or screen potential is usually applied to the tube through an electrically conductive metallic button 43 hermetically sealed in the wall of the funnel portion 17 of the envelope. Internally, the button makes connection with an electrically conductive coating 45, such as Aquadag, which is applied to the interior surface of the funnel portion 17 usually extending thereover into the forward area of the neck portion and thence to a line adjacent the panel seal 21. The electrical connection between the funnel disposed Aquadag coating 45 and the apertured mask member 33 is conventionally achieved by a resilient snubber means, not shown, which is usually attached to the frame 37 of the mask member and extended therefrom into the funnel portion 17 to make contact with the conductive coating 45 thereon.

The invention relates to an improvement in the mask-panel assembly of a color cathode ray tube wherein electrical contactor means 47 provides enhanced electrical connection between the mask member 33 and the metallized sidewall 25 of the panel. The electrical contactor 47 is formed as a substantially longitudinal member of flexible resilient metallic material, such as stainless steel. The contactor comprises an attachment portion 49 and an integral flexural contact portion 51. As shown in FIG. 1A, the flexural portion 51 is positioned in the spacing between the mask frame and the panel sidewall in a flexed attitude in a manner substantially parallel with and adjacent to the side portion of said mask frame whereby the attachment portion 49 is oriented toward and against the planar ledge of the frame 37 whereon it is affixed. Such flexured positioning of the contactor means, being substantially perpendicular to the planar ledge of the frame, effects pressured contact with the metallized film 31 on the sidewall of the panel 25 to provide a positive electrical connection between the mask and the panel-disposed conductive film 31, which in a shadow mask type of tube substantially covers the sidewall of the panel and the related cathodoluminescent screen.

Reference is directed to FIG. 2 wherein the contactor means 47 is shown in greater detail. The perspective view illustrates the configurative shaping of the contactor means prior to incorporation into the mask-panel assembly. In the embodiment shown, the attachment portion 49 is formed in a configurative manner to provide a substantially conventional clip-on feature that is compatible with a respective portion of the mask frame 37 to effect positive frictional engagement and affixation therewith. The integral flexural contact portion 51 is delineated in this embodiment as having a plurality of resilient fingers 53 extremitally formed and fashioned to provide multiple contact with the panel sidewall when incorporated into the mask-panel assembly. As shown, the flexural contact portion 51 has a slight transverse crease or apexially defined bend 55 formed therein in a manner to provide at least two areas of pressurized contact such as 57 and 59 with the panel sidewall 25 when positioned for utilization therewith. The angular formation of this definitive crease 55 is designated by the obtuse angle $\angle A$. The effects of this angular formation is clearly shown in FIG. 1 wherein the multiple contact areas 57 and 59 are clearly evidenced.

Another embodiment of the invention 47' is shown in FIG. 3, wherein the attachment portion 49' of the contactor means is a substantially flat tongue-like terminal portion formed for positioning on a substantially planar portion of the mask framing member 37 to facilitate affixation therewith by bonding means such as spot welding. It is essential when utilizing weld-bonding that extreme care be exercised to avoid deleterious spattering of metallic material in the mask and screen environment.

After positioning and effecting attachment of the electrical contactor means 47 within the mask-panel assembly, peripherally-oriented strip-like beam shielding means 35 are positionally attached to the mask frame in a manner to bridge the spacing between the frame 37 and the panel sidewall 25 to prevent the overscan of electron beams from reaching the screen 29. This shielding means is suitably affixed to the mask by conventional means, such as bonding or clip-type fasteners, not shown. In such an arrangement, the attachment related portion of the contactor means 47/47' is substantially sandwiched between the beam shielding means 35 and the mask frame 37. Since the beam shielding means is comprised of a substantially light weight metallic material, it readily conforms to the presence of the contiguous contactor and is in no manner hampered thereby.

While only one contactor means is shown in the drawings, a plurality may be utilized if so desired. It is readily evident that a substantial upgrading of the reliability and quality of the finished tube are distinct advantages effected by use of the contactor of the invention which provides a much greater area of contact surface than that normally achieveable between the conventional mask supporting means and the positioning studs in the panel sidewall.

Although the electrical contactor means of the invention is herein exemplarily described and shown in a shadow mask color tube environment, the breadth of concept is not intended to be limited thereto. For example, the contactor concept is equally applicable to a post deflection cathode ray tube utilization, wherein a specific electrical potential may be applied solely to the mask member through the medium of an insulated band of conductive material, applied to a discrete area of the panel sidewall, making contact therewith through a related button connection therein.

While there has been shown and described what are at present considered the preferred embodiments of the invention, it will be obvious to those skilled in the art that various changes and modifications may be made therein without departing from the scope of the invention as defined by the appended claims.

What is claimed is:

1. An improvement in a color cathode ray tube mask-panel assembly whereof the face panel includes a forwardly oriented viewing area with a cathodoluminescent screen interiorly formed thereon and a perimetrical wall therearound having an interiorly disposed electrically conductive film thereon, and whereof the mask portion of the assembly spatially supported within the panel includes a peripheral frame having a substantially planar ledge therearound wherefrom peripheral beam shielding means extend to substantially contact the panel wall, said improvement being enhanced electrical connective means within said assembly comprising:

metallic electrical contactor means formed as a resilient conductive member having an attachment portion and an integral flexural contact portion, said attachment portion being affixed to the planar ledge of said frame in a manner sandwiched between said frame and said shielding means, with said flexural portion being flexed substantially perpendicular thereto to effect substantially parallel positioning to the side portion of said frame in the spacing between said mask frame and the adjacent panel sidewall extending in a forwardly directed manner toward said viewing area, said flexed contact portion being formed as a plurality of parallel resilient fingers each making at least two areal regions of constant pressured contact with the panel sidewall to provide a plurality of positive areal electrical connections between the mask and the conductive film disposed on the wall of said panel.

* * * * *